US005179907A

United States Patent [19]

Galbraith

[11] Patent Number: 5,179,907

[45] Date of Patent: Jan. 19, 1993

[54] FLAG AND BUOY APPARATUS

[76] Inventor: Patricia Galbraith, 43204 Wolverine, Shawnee, Okla. 74801

[21] Appl. No.: 783,325

[22] Filed: Oct. 28, 1991

[51] Int. Cl.[5] ..... G09F 17/00; B63B 45/00

[52] U.S. Cl. ..... 116/209; 116/26; 116/173; 403/12; 403/174; 441/11

[58] Field of Search ..... 116/173, 26, 209; 441/6, 11, 129; 403/12, 174, 178, 175

[56] References Cited

U.S. PATENT DOCUMENTS

| | | | |
|---|---|---|---|
| 3,105,459 | 10/1963 | Conn | 116/173 |
| 3,149,352 | 9/1964 | Christiansen | 441/11 |
| 3,177,465 | 4/1965 | Wyatt | 340/5 |
| 3,234,903 | 2/1966 | Vara, Sr. | 116/63 P |
| 3,280,789 | 10/1966 | Lewis et al. | 116/173 |
| 3,656,749 | 4/1972 | Reyes | 273/105 |
| 3,660,855 | 5/1972 | Inman | 441/6 |
| 3,669,133 | 6/1972 | Hyman | 135/45 |
| 4,080,925 | 3/1978 | Moore | 116/173 X |
| 4,123,813 | 11/1978 | Adams | 441/11 |
| 4,144,606 | 3/1979 | McIntyre | 441/11 |
| 4,230,063 | 10/1980 | Chang | 116/63 T |

FOREIGN PATENT DOCUMENTS

| | | | |
|---|---|---|---|
| 0229758 | 1/1911 | Fed. Rep. of Germany | 441/11 |
| 0092479 | 9/1958 | Norway | 441/11 |
| 2158179 | 11/1985 | United Kingdom | 403/174 |

*Primary Examiner*—William A. Cuchlinski, Jr.
*Assistant Examiner*—W. Morris Worth
*Attorney, Agent, or Firm*—Head & Johnson

[57] ABSTRACT

A flag and buoy apparatus includes a body having a plurality of receptacles therein. The flag and buoy apparatus also includes a plurality of buoyant arms, each arm being receivable in one of the receptacles and extending radially from the body. Each arm is also tethered to the body. A pole assembly extends axially from the body to support the flag, the pole assembly being attachable to the body. The arms and the pole assembly may be detached from the body for storage of the apparatus.

6 Claims, 3 Drawing Sheets

FLAG AND BUOY APPARATUS

BACKGROUND OF THE INVENTION

1. Field of the Invention

The present invention relates to a flotation device to support a flag which may be placed in the water to indicate the presence of a scuba diver. In particular, the present invention relates to a flotation device to support a flag which may be quickly and simply assembled for use and may be quickly and simply disassembled and folded for storage.

2. Prior Art

Flag markers are required by regulation to be placed on the water to indicate the presence of a diver. A flag marker acts as a visible indicator to boat operators and others at the surface of the water. The flag itself traditionally includes a solid color background with a downward descending stripe.

The flag marker will be brought to each dive site by the diver and placed in the water during the dive. Even a minimal amount of scuba gear includes a significant amount of equipment, all of which must be brought to the dive site. After the dive, the flag marker will be removed and stored.

While various flag markers have been devised in the past, they suffer from a number of defects. Some consist of a single longitudinal pole which is easily susceptible to being buffeted by the wind or waves. Many of these devices are too large to be easily transported or, more importantly, to fit into the diver's bag of equipment.

Wyatt (U.S. Pat. No. 3,177,465) discloses a floatation device having extending legs that fold upward toward the central body when not in use.

Moore (U.S. Pat. No. 4,080,925) discloses a wind indicating device having a central body member and extending arms which may be inserted or be removed from the body portion and folded as seen in FIG. 2.

Conn (U.S. Pat. No. 3,105,459) discloses a safety float for skin divers having telescoping sections which are received within a cylindrical body.

Hyman (U.S. Pat. No. 3,669,133) discloses an example of a rod having tethered sections.

Vara (U.S. Pat. No. 3,234,903) discloses a foldable highway sign.

None of the prior art devices provide a buoyant flag support which is highly visible in the water, yet may be quickly assembled for use and then disassembled for storage.

Accordingly, it is a principal object and purpose of the present invention to provide a flag and buoy apparatus which is stable in the water, which may be quickly assembled for use and then disassembled for storage.

It is a further object and purpose of the present invention to provide a flag and buoy apparatus which is portable and which will fit in a compact space when disassembled.

SUMMARY OF THE INVENTION

The flag and buoy apparatus of the present invention includes a body constructed in the shape of a disk. A plurality of arms extend radially outward from the body. The arms are received in receptacles recessed into the body.

Each of the arms includes buoyant material which surrounds at least a portion of each arm.

An optional anchor attachment includes an anchor post extending axially from the body, the anchor post terminating in an eyelet.

Extending axially from the body is a pole receptacle. A lower pole section is received in the receptacle so that it is axially aligned with the body and with an upper pole section. Extending radially outward from the upper pole section is a boom pole. The upper pole is perpendicular to the boom pole.

One edge of a flag is secured to the boom pole. An adjacent edge of the flag is secured to the upper pole section.

The lower pole section, upper pole section, boom pole section, and flag comprise a pole assembly. The pole assembly may be separated from the apparatus by removing from the pole receptacle.

The lower pole section is tethered to the upper pole section by a tether line. The upper pole section is tethered to the boom pole section by a tether line. Accordingly, the pole assembly will be easily reassembled after disassembly.

Each arm is detachable from the body. When arms are separated from the body, a tether line between each arm and the body keeps the arm within a short distance therefrom. The tether lines are constructed from elastic, flexible cord.

DETAILED DESCRIPTION OF THE PREFERRED EMBODIMENT

Figure 1:
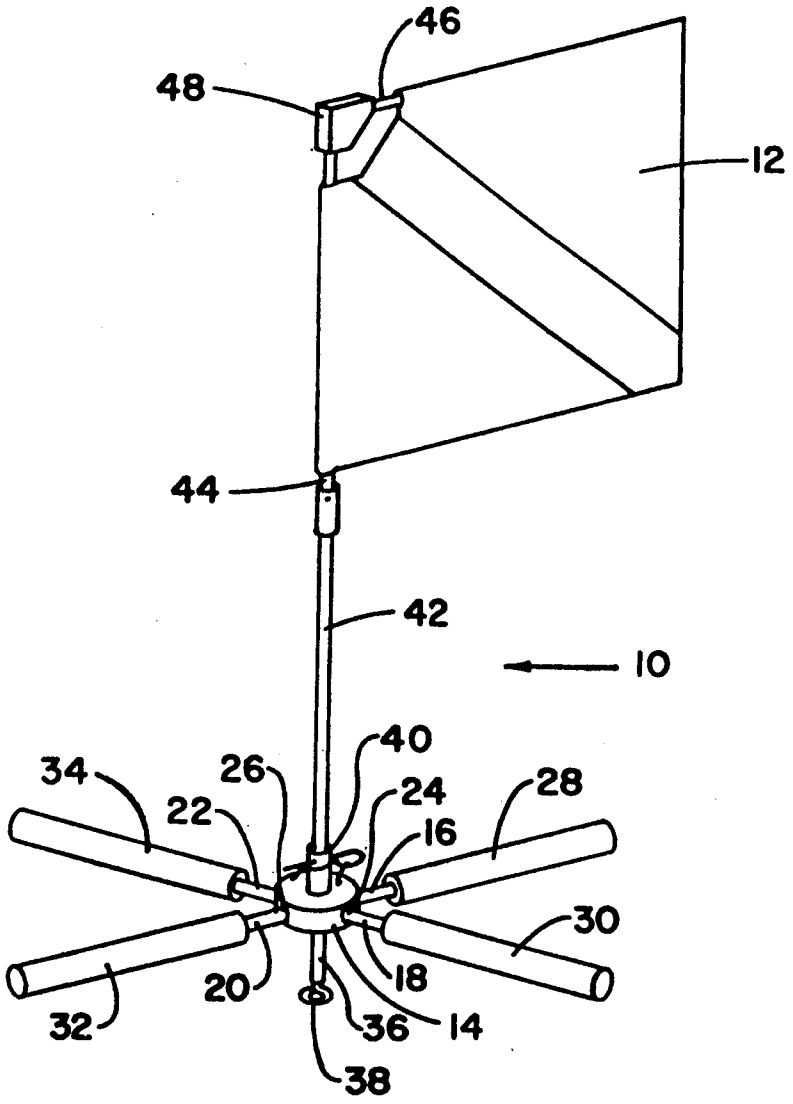
FIG. 1 shows a perspective view of a combination flag and buoy apparatus constructed in accordance with the present invention.

Referring to the drawings in detail, FIG. 1 depicts a perspective view of a combination flag and buoy apparatus 10 which would float on the surface of the water.

In the present embodiment, the apparatus 10 is particularly suited for use as an indicator to be utilized by divers although it may be utilized anytime a portable indicator is desirable to be displayed on water.

The apparatus 10 includes a body 14 which would be constructed of a sturdy, lightweight material. A rigid plastic has been found to be particularly suited for this purpose. The body 14 is in the shape of a disk in the present embodiment although alternate shapes might be utilized.

A plurality of arms 16, 18, 20, and 22 extend radially outward from the body 14. The arms are received in receptacles recessed into the body. Receptacles 24 and 26 for arms 18 and 20 are visible in FIG. 1.

Each of the arms 16, 18, 20, and 22 include buoyant material 28, 30, 32 and 34, respectively, which surrounds at least a portion of each arm. If the apparatus were to become submerged, the buoyant material would cause the entire apparatus to rise to the surface.

In the present embodiment, four arms are utilized that are spaced 90° radially from each other. It will be recognized that a greater number of arms might be employed. The upper pole section is perpendicular to the boom pole 46.

The radially extending arms provide a great deal of stability from the forces of wind and waves.

An optional anchor attachment includes an anchor post 36 which extends axially from the body and terminates in an eyelet 38. An anchor and accompanying line (not shown) may be secured to the eyelet so that the apparatus 10 will not drift in the water.

Extending axially from the body is a pole receptacle 40. The pole receptacle may be fashioned from a member upstanding from the body as seen in FIG. 1 or may be simply recessed in the body.

A lower pole section 42 is received in the receptacle 40 so that it is axially aligned with the body 14 and upper pole section 44. Extending radially outward from the upper pole section 44 is a boom pole 46. A corner elbow 48 may facilitate the connection between the boom pole and the upper pole section.

One edge of the flag 12 is secured to the boom pole 46. An adjacent edge of the flag 12 is secured to the upper pole section 44. This may be accomplished through a sleeve formed in the flag. As arranged, the flag will be continuously unfurled so that it is readily visible from a great distance.

The lower pole section 42, upper pole section 44, boom pole section 46 and flag comprise a pole assembly of the apparatus 10.

The pole assembly might have an optional lock in the form of a cotter pin that would be received through an opening (not visible in FIG. 1) in the lower pole section 42.

Figure 2:
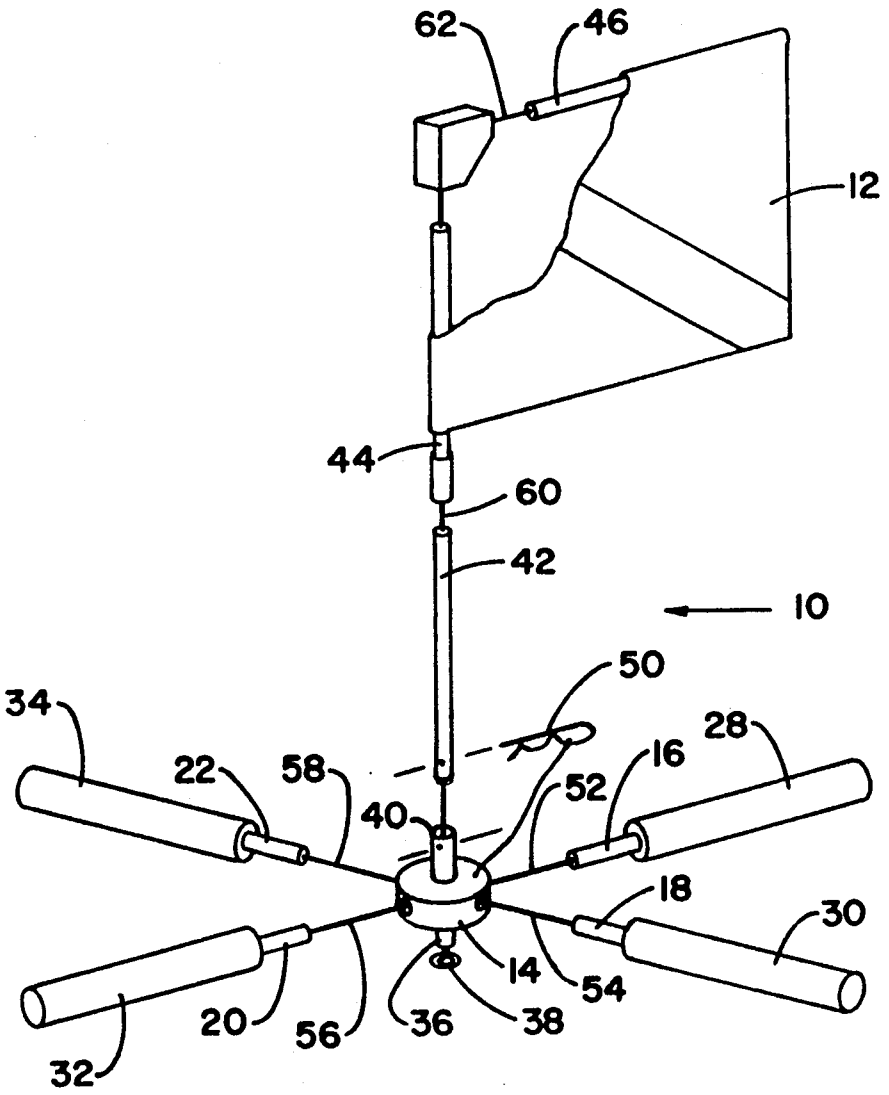
FIG. 2 shows a partially exploded view of the combination flag and buoy apparatus shown in FIG. 1.

FIG. 2 illustrates a partially exploded view of the apparatus 10.

Each arm 16, 18, 20, and 22 is detachable from the body 14. When the legs are separated from the body 14, the tether lines 52, 54, 56, and 58 are readily visible. The tether lines are constructed of an elastic, flexible cord. In the event one of the arms becomes dislodged from the body, it will not be lost in the water. Likewise, when the apparatus is to be assembled, each arm is located in close proximity to the proper receptacle.

Turning to the flag pole assembly, the lower pole section 42 is tethered to the upper pole section 44 by tether line 60. The upper pole section 44 is tethered to boom pole section 46 by a tether line 62. The tether lines are constructed of an elastic, flexible cord. In the event one of the sections becomes dislodged, it will not be lost in the water. Once the pole assembly has been disassembled, it may be quickly and easily assembled since the pieces remain in close proximity to their assembly condition.

Figure 3:
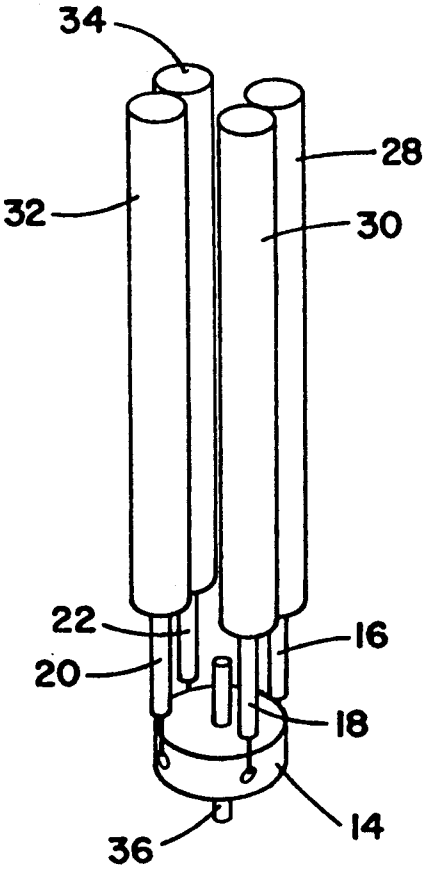
FIG. 3 is a perspective view of the arms and body of the flag and buoy apparatus shown in FIG. 1 when disassembled.

FIG. 3 illustrates a perspective view of the arms 16, 18, 20, and 22 apart from the body. Each arm remains tethered to the body and in close proximity therewith. The arms may be gathered together, as shown in FIG. 3, so that they will be compact and take up a small amount of space. As arranged, they will be readily placed in the separate bag or in the diver's bag.

Figure 4:
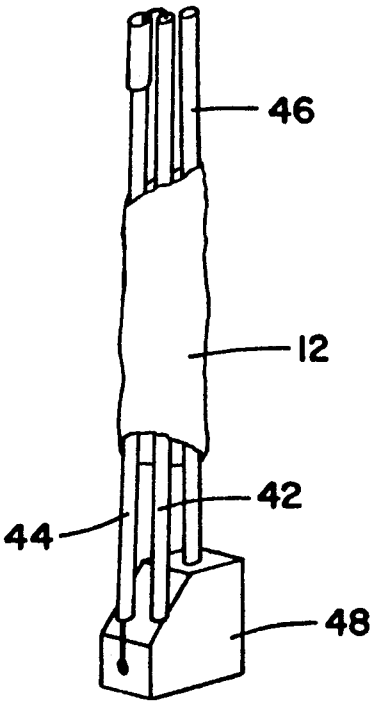
FIG. 4 is a perspective view of the pole assembly of the flag and buoy apparatus shown in FIG. 1 when disassembled.

FIG. 4 illustrates components of the pole assembly, namely, the lower pole section 42, the upper pole section 44, and the boom pole section 46. When the flag pole assembly is detached from the body, the components of the flag pole assembly may be gathered together and folded as shown in FIG. 4. The flag pole assembly will thus be compact and may be placed in a separate bag (not shown) or in the diver's equipment bag.

Whereas, the present invention has been described in relation to the drawings attached hereto, it should be understood that other and further modifications, apart from those shown or suggested herein, may be made within the spirit and scope of this invention.

What is claimed is:

1. A flag and buoy apparatus which comprises:

a body having a plurality of receptacles recessed into said body;

a plurality of buoyant arms, each arm receivable in one of said receptacles and extending radially from said body; flexible, stretchable cord means extending between each said arm and said receptacles to maintain each arm in close proximity to said receptacles when disassembled or dislodged;

a flag; and pole means extending axially from said body to support said flag, said pole means attachable to said body by means for receiving said pole means, wherein said arms and said pole means may be attached to said body for use and detached from said body for storage of said apparatus.

2. A flag and buoy apparatus as set forth in claim 1 including means to attach an anchor line to said apparatus.

3. A flag and buoy apparatus as set forth in claim 2 wherein said means to attach an anchor line includes a protrusion extending from said body opposite said pole means and eyelet means for attaching an anchor line thereto.

4. A flag and buoy apparatus as set forth in claim 1 having four said buoyant arms, wherein adjoining arms are spaced 90 degrees apart radially.

5. A flag and buoy apparatus as set forth in claim 1 wherein said pole means includes a lower pole section attachable to said pole receiving means, an upper pole section attachable to said lower pole section, and a boom pole extending radially from said upper pole section and detachable therefrom, wherein said lower pole section is tethered to said upper pole section and said upper pole section is tethered to said boom pole.

6. A flag and buoy apparatus as set forth in claim 5 wherein said lower pole section is tethered to said upper pole section by a flexible, stretchable cord and wherein said upper pole section is tethered to said boom pole by a flexible, stretchable cord.

* * * * *